US007034780B2

(12) United States Patent
Fujita et al.

(10) Patent No.: US 7,034,780 B2
(45) Date of Patent: Apr. 25, 2006

(54) PLASMA DISPLAY DEVICE WITH VIDEO MUTING FUNCTION

(75) Inventors: Satoshi Fujita, Tokyo (JP); Akihiro Kasai, Tokyo (JP)

(73) Assignee: Pioneer Corporation, Tokyo (JP)

( * ) Notice: Subject to any disclaimer, the term of this patent is extended or adjusted under 35 U.S.C. 154(b) by 209 days.

(21) Appl. No.: 10/329,462

(22) Filed: Dec. 27, 2002

(65) Prior Publication Data

US 2003/0122744 A1 Jul. 3, 2003

(30) Foreign Application Priority Data

Dec. 27, 2001 (JP) ..... 2001-397476

(51) Int. Cl.
*G09G 3/28* (2006.01)

(52) U.S. Cl. ..... 345/63

(58) Field of Classification Search ..... 345/60–72, 345/204, 211, 213, 699, 698
See application file for complete search history.

(56) References Cited

U.S. PATENT DOCUMENTS 4,635,050 A * 1/1987 Grothe et al. ..... 345/16
5,329,290 A * 7/1994 Schwarz et al. ..... 345/698
6,822,660 B1 * 11/2004 Kim ..... 345/699

FOREIGN PATENT DOCUMENTS

JP 7-134577 A 5/1995
JP 07-134577 A 5/1995
JP 9-135395 A 5/1997
JP 10-063219 A 3/1998
JP 10-097214 A 4/1998
JP 11-231831 A 8/1999
JP 2000-137457 A 5/2000

* cited by examiner

*Primary Examiner*—Xiao Wu
*Assistant Examiner*—Kevin M. Nguyen
(74) *Attorney, Agent, or Firm*—Sughrue Mion, PLLC

(57) ABSTRACT

A plasma display device is provided which is capable of preventing image disturbance and imposition of excessive loads even when resolution is switched. A vertical frequency counter counts vertical sync signals using system clocks and a vertical frequency comparator checks whether or not the value obtained from the counting matches up with a vertical frequency decoded value. A line number counter counts vertical sync signals using horizontal sync signals and a line number comparator checks whether or not the value obtained from the counting matches up with a line number decoded value. A dot number counter counts horizontal sync signals using analog digital clocks and a dot number comparator checks whether or not the value obtained from the counting matches up with a dot number decoded value. These values are ORed by an OR circuit and the result is output in a form of a mode monitoring detection signal.

9 Claims, 5 Drawing Sheets

PLASMA DISPLAY DEVICE WITH VIDEO MUTING FUNCTION

BACKGROUND OF THE INVENTION

1. Field of the Invention

The present invention relates to a plasma display device that can be suitably used as a flat display and more particularly to the plasma display device being capable of preventing a faithful reproduction in image from be disturbed when its resolution is switched.

The present application claims priority of Japanese Patent Application No. 2001-397476 filed on Dec. 27, 2001, which is hereby incorporated by reference.

2. Description of the Related Art

When resolution is switched by a remote control unit or by a switch of a main body of a display device or a like, for example, when a signal to be input to the display device is switched from a video signal fed from a personal computer to a video signal fed from a video deck, though the input signal can be switched immediately, since an operational mode signal is discriminated by a microcomputer, a time delay occurs before a result from the discrimination is output. As a result, a state occurs in which the input signal temporarily does not match up with the operational mode signal and, during the state, an incorrect signal is output. However, since the microcomputer can output a muting signal with timing when a switching operation is performed, it is possible to prevent a faithful reproduction in image from being disturbed.

On the other hand, in recent years, as enhancement of resolution becomes possible through processing by a personal computer, in many cases, resolution is switched while an image is being displayed. That is, the switching of resolution is done without switching operations by using a remote control unit or by a switch of a main body of the display device, for example, resolution is switched while cables of a personal computer are being connected. In such the case, according to a conventional circuit configuration, though an input signal can be switched immediately, a mode signal is discriminated by a microcomputer. Due to this, a time delay occurs in transmission of the mode signal and an image muting signal is not output from the microcomputer which causes outputting of an incorrect signal. As a result, an inconvenience including disturbance of faithfully reproduction images and imposition of a load exceeding a supply capability on a power supply circuit occurs.

To solve this problem, a display device is disclosed in, for example, Japanese Patent Application Laid-open No. Hei 7-134577in which, when a display mode is switched or a signal source is switched, an image being at a black level is displayed to prevent a faithful reproduction in image from being disturbed.

Moreover, a video display device is disclosed in Japanese Patent Application Laid-open No. Hei 9-135395 in which judgement as to whether or not a frequency of an input signal fed to a CRT (Cathode Ray Tube) is stable is made by a micro-control unit and if the input signal is not stable, a video signal is muted.

Furthermore, another display device is disclosed in Japanese Patent Application Laid-open No. 2000-137457 in which, when a deflection frequency of a video signal fed to a CRT is changed, muting of a video signal is performed.

Moreover, in recent years, as a thin and lightweight display device, a plasma display device is becoming commonly used. A method for driving a plasma display device is basically different from that for a CRT. That is, in the case of the plasma display device, a method in which a digitized video input signal is directly controlled is employed and one field period is divided into a plurality of sub-field periods and whether light is emitted or not during each sub-field period is determined according to a weight of a bit making up a video signal. Each of the sub-field periods is made up of a pre-discharging period, a scanning period, and a sustaining period and brightness in each sub-field period is determined by controlling a number of sustaining pulses in the sustaining period based on an average luminance level. For example, control is exerted in a manner that, if an average luminance level is judged to be low, a number of the sustaining pulses is increased to enhance peak luminance and, if the average luminance level is judged to be high, the number of the sustaining pulses is decreased to reduce power consumption.

FIG. 5 is a schematic block diagram showing conventional configurations of a display device being used when the display device on which an image being at a black level is displayed so as not to display unfaithful images reproduced in response to an incorrect signal, for example, when a signal source is switched is applied to a plasma display device.

In the conventional display device shown in FIG. 5, an analog video signal is converted into a digital signal by an A/D (Analog-to-Digital) converter 1 and is then input to a video signal processing circuit 2. To the video signal processing circuit 2 are further input a mode signal, a vertical sync signal, a horizontal sync signal, and an AD (Analog-digital) clock. The vertical sync signal is also input to a driving control circuit 3. To the driving control circuit 3 is further input a system clock. Also, to the driving control circuit 3 is input an average luminance level signal (not shown) obtained from arithmetic operations on an average luminance level, from the video signal processing circuit 2. Then, a plasma display panel (PDP) 4 is driven by digital video signals (output not shown) for RGB (Red, Green, and Blue) colors output from the video signal processing circuit 2 and driving signals output from the driving control circuit 3 or a like to display images.

Moreover, so long as resolution is switched by a remote control unit or a switch of a main body of the display device, what ever an input average luminance level value is, when a signal is switched, since an image is muted, a load exceeding a supply capability is not imposed on a power supply circuit (not shown).

However, the conventional display device has a problem in that, for example, if resolution is switched while cables of a computer are being connected, since several field periods to several tenth field periods are required for judgement of a mode, a video signal to be output from the video signal processing circuit 2 to the PDP 4 is not assured at all during these periods. In the video signal processing circuit 2, though an arithmetic operation on an average luminance level in one screen (during one field period) is performed, a result obtained from the arithmetic operation on an average luminance level is not assured until the judgement of a mode is firmly confirmed. Due to this, a contradiction occurs between a video signal to be output from the video signal processing circuit 2 to the PDP 4 and an average luminance level signal to be output from the video signal processing circuit 2 to the driving control circuit 3 based on the result obtained from the arithmetic operation on an average luminance level, As a result, there is a problem that, for example, a video signal causes display of a whole white image and an average luminance level signal causes display of an image providing a maximum luminance. In this case, excessive loads are imposed on the power source (not shown) and PDP 4.

SUMMARY OF THE INVENTION

In view of the above, it is an object of the present invention to provide a plasma display device which is capable of preventing image fidelity from being disturbed, and excessive loads from being imposed, even when resolution is switched.

According to a first aspect of the present invention, there is provided a plasma display device including:

a plasma display panel;

a video signal processing circuit to output a video signal to the plasma display panel based on a vertical sync signal, a horizontal sync signal, and an analog digital clock signal;

a mode monitoring circuit to monitor and check whether or not a numerical value of a vertical frequency indicated by the vertical sync signal matches up with a numerical value of a vertical frequency obtained by decoding an operation mode signal which is switched depending on resolution; and wherein the video signal processing circuit, while a result from the monitoring performed by the mode monitoring circuit shows non-matching between the numerical values of the vertical frequencies, outputs a video muting signal, instead of the video signal, to the plasma display panel.

According to a second aspect of the present invention, there is provided a plasma display device including:

a plasma display panel;

a video signal processing circuit to output a video signal to the plasma display panel based on a vertical sync signal, a horizontal sync signal, and an analog digital clock signal;

a mode monitoring circuit to monitor and check whether or not a number of lines indicated by the horizontal sync signal matches up with a number of lines obtained by decoding an operation mode signal which is switched depending on resolution; and wherein the video signal processing circuit, while a result from the monitoring performed by the mode monitoring circuit shows non-matching between the number of lines, outputs a video muting signal, instead of the video signal, to the plasma display panel.

According to a third aspect of the present invention, there is provided a plasma display device including:

a plasma display panel;

a video signal processing circuit to output a video signal to the plasma display panel based on a vertical sync signal, a horizontal sync signal, and an analog digital clock signal;

a mode monitoring circuit to monitor and check whether or not a number of dots indicated by the analog digital clock signal matches up with a number of dots obtained by decoding an operation mode signal which is switched depending on resolution; and wherein the video signal processing circuit, while a result from the monitoring performed by the mode monitoring circuit shows non-matching between the number of dots, outputs a video muting signal, instead of the video signal, to the plasma display panel.

In the foregoing, a preferable mode is one wherein the mode monitoring circuit monitors and checks whether or not a number of lines indicated by the horizontal sync signal matches up with a number of lines obtained by decoding an operation mode signal which is switched depending on resolution.

Also, a preferable mode is one wherein the mode monitoring circuit monitors and checks whether or not a number of dots indicated by the analog digital clock signal matches up with a number of dots obtained by decoding an operation mode signal which is switched depending on resolution.

By configuring as above, even if resolution is switched while cables of a personal computer are being connected and, as a result, a delay occurs in switching of operation mode signals, instantaneously a video muting operation can be performed. Therefore, it is possible to avoid displaying unfaithful images and imposing excessive loads in response to an incorrect signal.

Furthermore, a preferable mode is one wherein the video signal processing circuit fixes an input average luminance level so as to be a pre-determined constant value, in synchronization with the video muting signal.

With the above configurations, since monitoring is performed by the mode monitoring circuit to check whether or not a decoded value of an operation mode signal matches up with a decoded value obtained from the vertical sync signal, horizontal sync signal and/or AD clock and, based on the result from the above monitoring, a video muting signal, instead of a video signal, is input to the PDP, even if a delay occurs in switching of operation mode signals when resolution is switched, video muting can be instantaneously performed. Therefore, it is possible to prevent faithful reproduction of images from being disturbed, and imposition of excessive loads.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Embodiment

Figure 1:
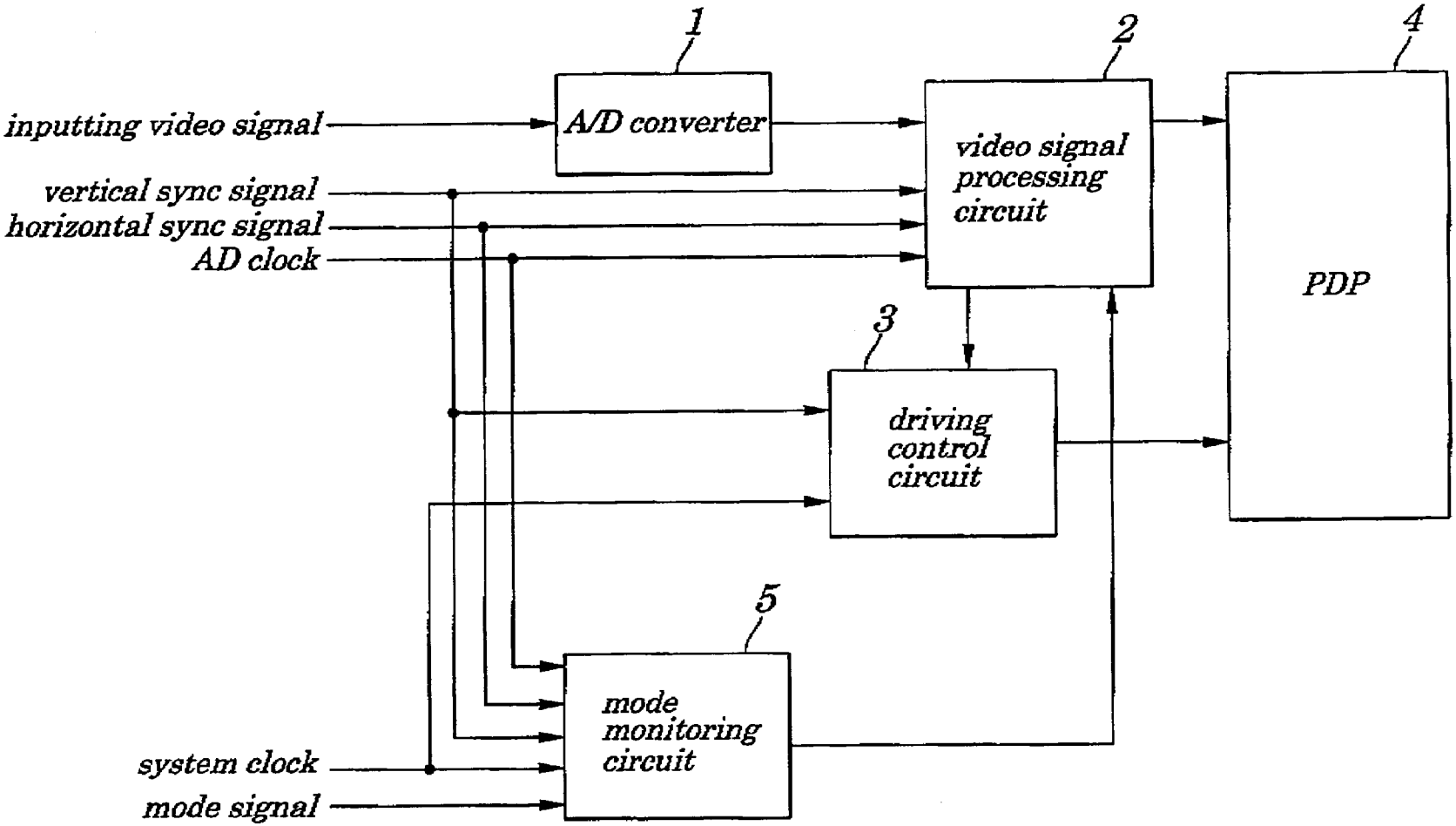
FIG. 1 is a schematic block diagram showing main components of a plasma display device according to an embodiment of the present invention.

FIG. 1 is a schematic block diagram showing main components of a plasma display device according to an embodiment of the present invention. The plasma display device of the embodiment includes an A/D converter 1 to convert an input analog video signal into a digital video signal, a video signal processing circuit 2 to divide one field period into a plurality of sub-field periods and to output a video signal to a PDP 4, and a driving control circuit 3 to produce a driving signal from a vertical sync signal and a system clock signal to drive the PDP 4. The plasma display device of the embodiment also has a mode monitoring circuit 5 to monitor states of a horizontal sync signal, a vertical sync signal, an AD clock, a system clock, and a mode signal and to control the video signal processing circuit 2.

Figure 2:
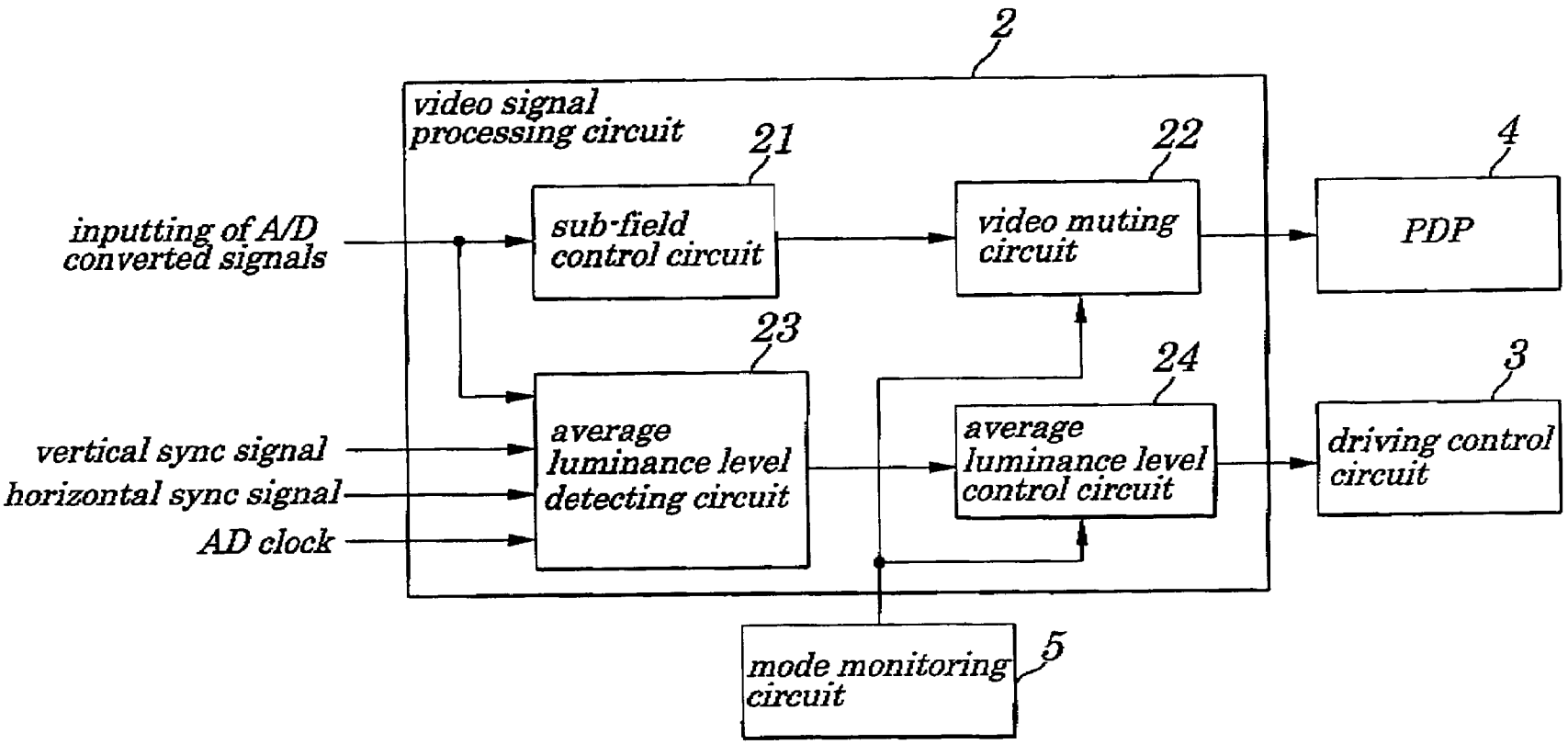
FIG. 2 is a schematic block diagram showing configurations of a video signal processing circuit according to the embodiment of the present invention.

FIG. 2 is a schematic block diagram for showing configurations of the video signal processing circuit 2 according to the embodiment of the present invention. The video signal processing circuit 2 further has a sub-field control circuit 21 to divide A/D converted digital video signals so as to correspond to each of sub-field periods and to sort them so that image display is performed on the PDP 4 and a video muting circuit 22 to select whether the video signal divided so as to correspond to each of the sub-field periods is output as it is, or muted, based on a match/non-match detecting signal (hereinafter may referred to as mode monitoring detection signal) fed from the mode monitoring circuit 5. The video signal processing circuit 2 also has an average luminance level detecting circuit 23 to count active pixels for a video signal to be input for every bit during one field period using an AD clock and to assign weights to them and then to output them in every one field period and an average luminance level control circuit 24 to select whether an input average luminance level is output as it is, or the average luminance level is switched to a predetermined maximum level and output, based on a match/non-match detecting signal, that is, mode monitoring detection signal fed from the mode monitoring circuit 5.

Figure 3:
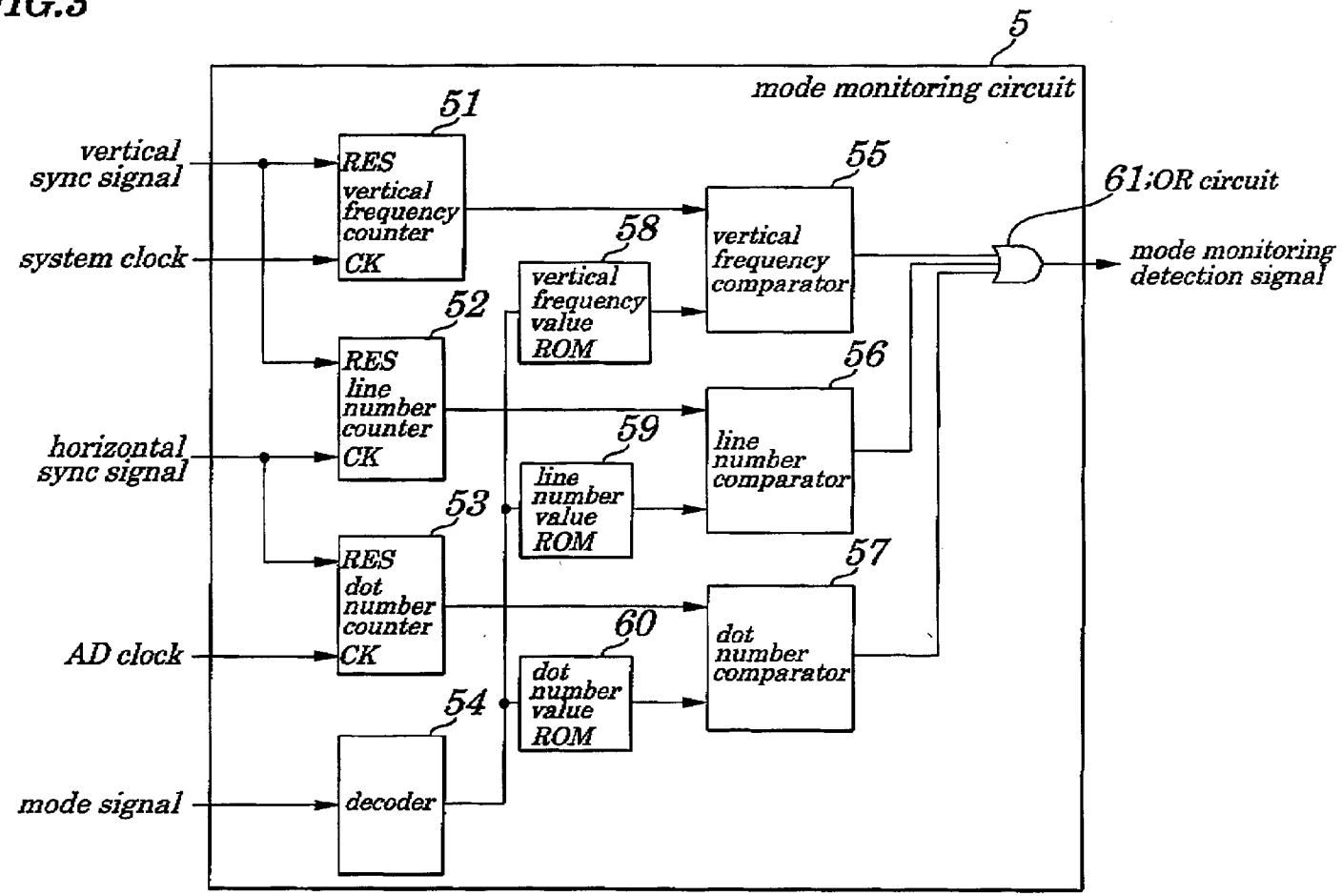
FIG. 3 is a schematic block diagram showing configurations of a mode switching circuit according to the embodiment of the present invention.

FIG. 3 is a schematic block diagram for showing configurations of the mode monitoring circuit 5 according to the embodiment. The mode monitoring circuit 5 of the embodiment also has a vertical frequency counter 51 to count vertical sync signals by using a system clock being not synchronous with an input signal and to detect a numerical value of a vertical frequency from a number of system clocks during one field period, a line number counter 52 to count input vertical sync signals based on an input horizontal sync signal and to detect a number of lines during one field, a dot number counter 53 to count input horizontal sync signals based on an input AD clock signal and to detect a number of dots during one line, and a decoder 54 to decode operational mode signals. Moreover, the mode monitoring circuit 5 also has a vertical frequency value ROM 58 to store a vertical frequency decoded value representing a numerical value of a vertical frequency of signals fed from the decoder 54, a line number value ROM 59 to store a line number decoded value representing a number of lines fed from the decoder 54, and a dot number value ROM 60 to store a dot number decoded value representing a number of dots fed from the decoder 54. The mode monitoring circuit 5 further has a vertical frequency comparator 55 to compare a counter value being a signal output from the vertical frequency counter 51 with a value output from the vertical frequency value ROM 58, a line number comparator 56 to compare a counter value being a signal output from the line number counter 52 with a value output from the line number value ROM 59, and a dot number comparator 57 to compare a count value being a signal output from the dot number counter 53 with a value output from the dot number value ROM 60. Moreover, the mode monitoring circuit 5 is also provided with an OR circuit 61 to OR a signal output from each of the vertical frequency comparator 55, the line number comparator 56, and the dot number comparator 57 and to output a mode monitoring detection signal (match/non-match detecting signal).

Next, operations of the plasma display device having configurations as described above are explained.

When analog RGB signals input from a personal computer or analog RGB signals obtained by decoding video signals in which luminance signals and color signals are superimposed on each other are input into the plasma display device, the A/D converter 1 converts these analog signals to digital video signals.

Moreover, in the mode monitoring circuit 5, the vertical frequency counter 51 counts input vertical sync signals using asynchronous system clocks during one field period and the vertical frequency comparator 55 compares a value obtained by the counting with a vertical frequency decoded value representing a vertical frequency fed from the decoder 54 to judge whether or not these values match up with each other. Also, the line number counter 52 counts input vertical sync signals using horizontal sync signal during one field period and the line number comparator 56 compares values obtained by the counting with line number decoded values representing a number of lines fed from the decoder 54 to judge whether or not these values match up with each other. Similarly, the dot number counter 53 counts input horizontal sync signals using AD clocks during one line and the dot number comparator 57 compares values obtained by the counting with dot number decoded values representing a number of dots fed from the decoder 54 to judge whether or not these values match up with each other. In any one of the vertical frequency comparator 55, line number comparator 56, and dot number comparator 57, for example, if a result from the comparison shows that the above compared values match up with each other, a low-level signal is output and if a result from the comparison shows that the above compared values do not match up with each other, a high level signal is output. Then, these values are ORed by the OR circuit 61 and the result is output in a form of a mode monitoring detection signal and input to the video muting circuit 22 and the average luminance level control circuit 24 in the video signal processing circuit 2.

In the video signal processing circuit 2, the sub-field control circuit 21 divides digital RGB signals obtained by A/D conversion processing in the A/D converter 1, for example, digital RGB signals of 8 bits so as to correspond to each of the sub-field periods and sorts them so that image display on the PDP 4 can be achieved. Then, the video muting circuit 22, if the mode monitoring detection signal output from the mode monitoring circuit 5 shows that there is a match in mode, outputs video signals fed from the sub-field control circuit 21 to the PDP 4 as they are, and if the mode monitoring detection signal shows that there is no match in mode, performs muting operations on the video signals only during pre-determined periods existing at least before the period during which there is no match in mode ends, and then switches the muting signals into video signals and outputs them to the PDP 4.

Moreover, the input average luminance level detecting circuit 23 counts active pixels for a RGB video signal to be input for every bit during one field period using AD clocks and assigns weights to them and then outputs added results. Then, the average luminance level control circuit 24, if the mode monitoring detection signal output from the mode monitoring circuit 5 shows that there is a match in mode, outputs a signal fed from the average luminance level detecting circuit 23 to the driving control circuit 3 as they are and, if the mode monitoring detection signal shows that there is no match in mode, switches the average luminance level to a maximum value only during pre-determined periods within which at least non-matching in mode ends and then also switches it to an output from the average luminance level detecting circuit 23 and outputs it to the driving control circuit 3. Moreover, an output from the average luminance level detecting circuit 23 is updated for every one field period.

Then, the driving control circuit 3 produces a driving signal using a vertical sync signal and a system clock signal and the PDP 4 performs display of an image based on a signal fed from the video signal processing circuit 2 and the driving signal control circuit 3.

Figure 4:
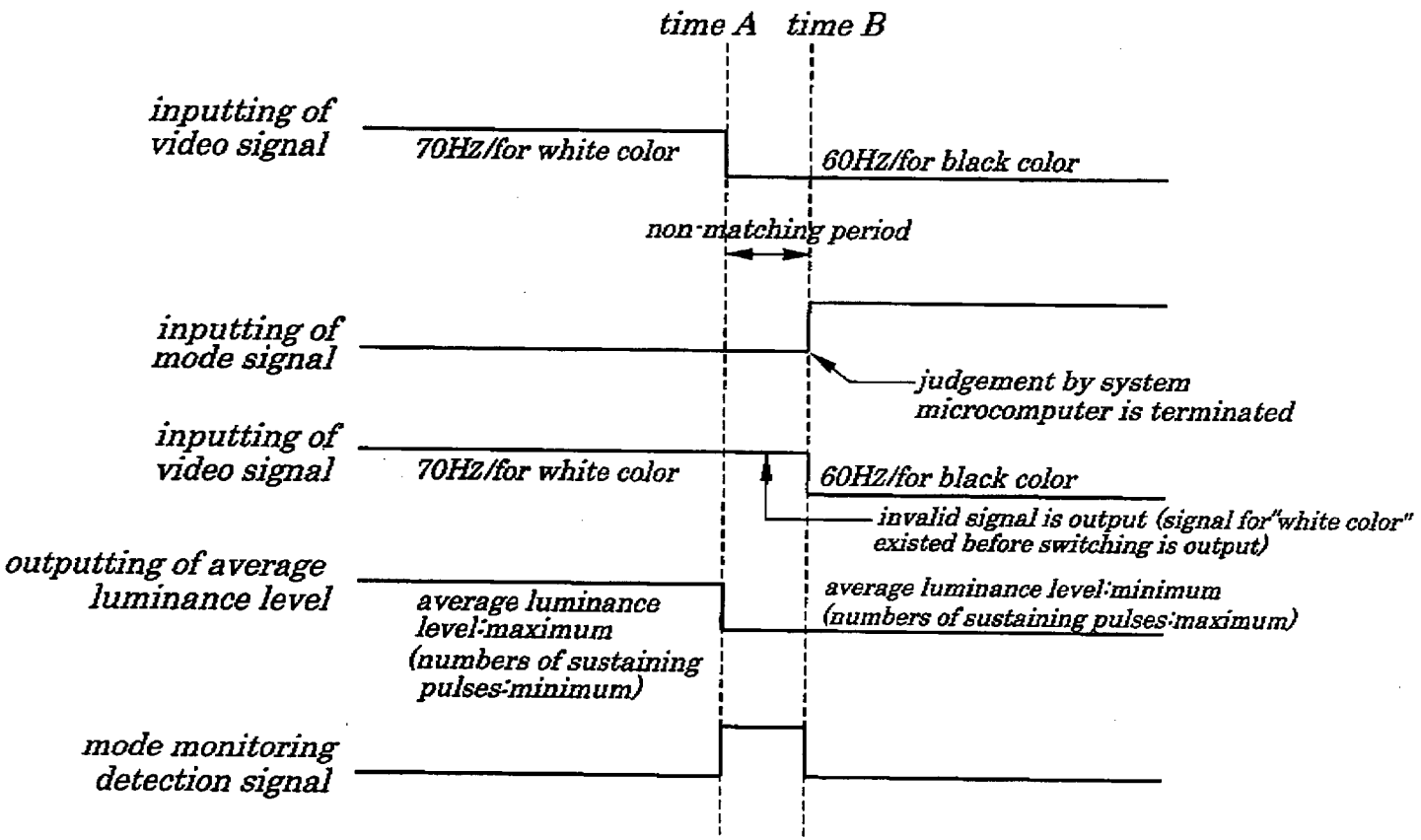
FIG. 4 is a timing chart explaining operations of the plasma display device of the embodiment of the present invention.
Figure 5:
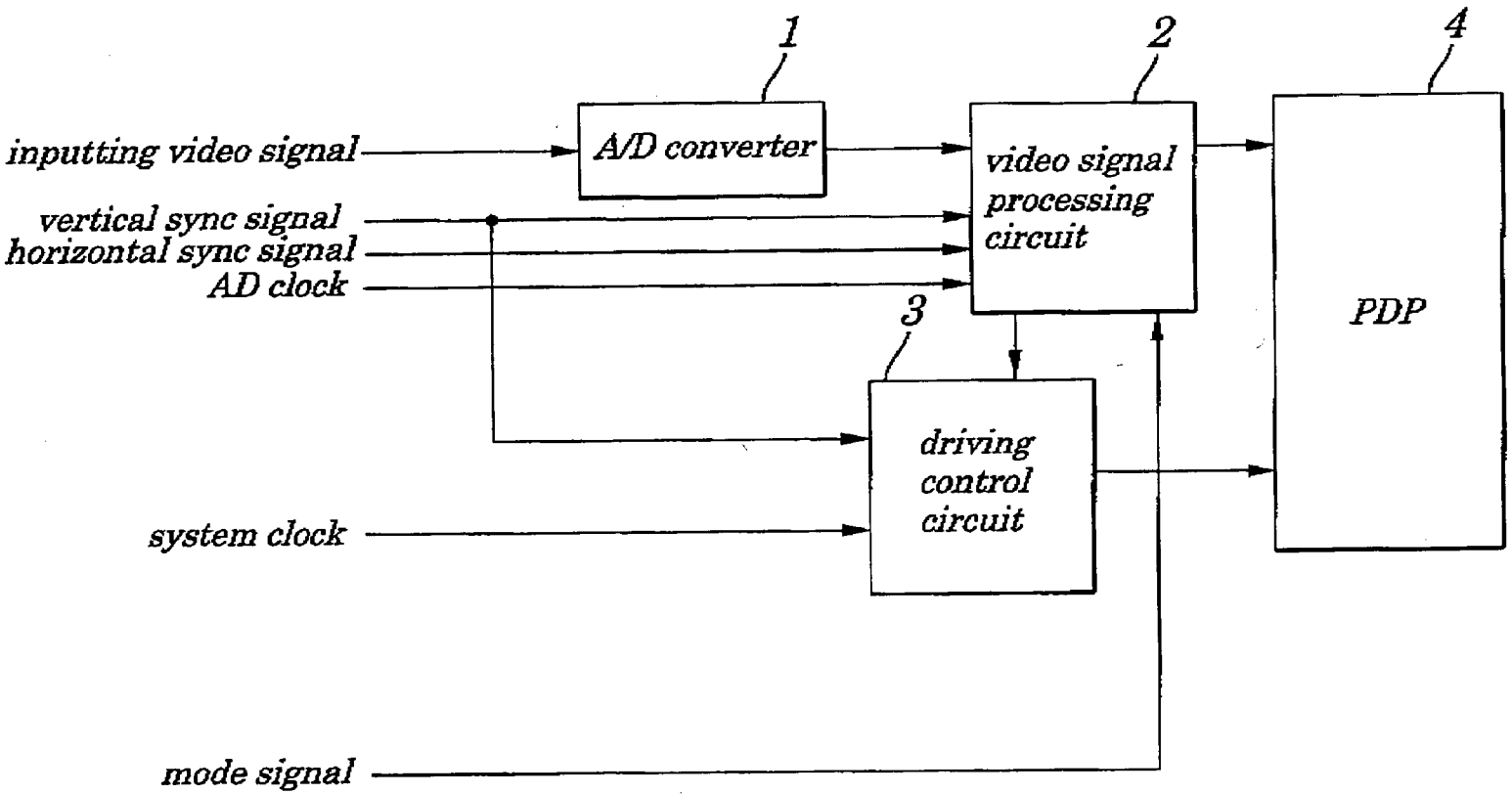
FIG.5 (PRIOR ART)
FIG. 5 is a schematic block diagram showing conventional configurations being used when a display device on which an image being at a black level is displayed so as not to display unfaithful images reproduced in response to an incorrect signal, for example, when a signal source is switched is applied to a plasma display device.

Next, more specific operations of the plasma display device of the embodiment are described by referring to FIG. 4. FIG. 4 is a timing chart explaining operations of the plasma display device of the embodiment of the present invention.

For example, when a vertical frequency of an input signal is switched from 70 Hz to 60 Hz at a time "A", a system microcomputer cannot detect its change until a time "B". Due to this, between the time "A" and the time "B", a state occurs where an input signal does not match up with an operation mode signal, which is called "non-matching period". Moreover, when a video signal is switched from a signal for a white color to a signal for a black color, during the time between the time "A" and the time "B", due to the non-matching between an input signal and an operation mode signal, a signal for a white color that existed before the switching is output, as an incorrect signal, from the sub-field control circuit 21.

Moreover, the average luminance level detecting circuit 23 counts input signals for a black color and therefore the input average luminance level becomes a minimum value at the time "A", that is, the number of sustaining pulses becomes maximum. As a result, between the time "A" and the time "B", a video is displayed in white which is induced by an incorrect signal and further the number of the sustaining pulses becomes maximum.

As a result, if an output signal from the sub-field control circuit 21 is output to the PDP 4 as it is and an output from the average luminance level detecting circuit 23 is output to the PDP 4 as it is, excessive currents flow into a sustaining circuit and a state occurs where a load exceeding a power source capability is imposed.

However, in the embodiment, since actual input signals and operation mode signals are monitored, even if switching of the vertical frequency as described above is done, a result from comparison fed from the vertical frequency comparator 55 is judged, immediately after the time "A", to be non-matching and therefore a muting operation is performed on a video signal and an input average luminance level is fixed at a maximum value (that is, the number of sustaining pulses being minimum) until the time "B" before the non-matching period ends at the shortest As a result, excessive loads that are imposed on a power supply source and the PDP 4 can be avoided.

Thus, according to the plasma display device of the embodiment, since it is possible to monitor whether or not an operation mode signal representing frequencies of a vertical sync signal input from an outside, numbers of horizontal display lines, or a like matches up with a signal actually input, an unstable state caused by non-matching between the input signal and the operation mode signal at a time of switching of signals being not accompanied by switching operations of a remote control unit or a main body of the plasma display device can be avoided and image disturbance and excessive loads can be also prevented. Moreover, even if a user sets the operation mode signal erroneously, similar effects can be obtained.

Moreover, when a mode monitoring detection signal output from the mode monitoring circuit 5 shows there is no match in modes, the video muting circuit 22 is allowed to reduce a level of a video signal or may set to be a signal at a constant level, for example, a signal of a single blue color or a like.

Also, if the result of the detection showing non-match is cancelled, control may be exerted so that images are displayed gradually thereafter.

Also, instead of the video muting, blanking control on a data driver circuit (not shown) of the PDP 4 may be exerted. Moreover, both the video muting and the blanking control may be performed simultaneously.

Furthermore, if a mode monitoring detection signal output from the mode monitoring circuit 5 shows non-match in modes, the average luminance level control circuit 24 may set an average luminance level to be a fixed value so that the average luminance level falls within supply capability of a power supply circuit.

It is apparent that the present invention is not limited to the above embodiments but may be changed and modified without departing from the scope and spirit of the invention.

What is claimed is:

1. A plasma display device comprising:

a plasma display panel;

a video signal processing circuit for supplying a video signal to said plasma display panel based on a vertical sync signal, a horizontal sync signal, and an analog digital clock signal; and a mode monitoring circuit for generating a decoded value indicating a vertical frequency by decoding an operation mode signal which is switched depending on a resolution, and for monitoring and checking whether or not a numerical value indicating a vertical frequency of said vertical sync signal matches up with said decoded value, wherein said video signal processing circuit, while a result of the monitoring performed by said mode monitoring circuit shows non-matching between said numerical value and said decoded value, outputs a video muting signal, instead of said video signal, to said plasma display panel.

2. The plasma display device according to claim 1, wherein said mode monitoring circuit further generates a decoded value representing a number of lines by decoding the operation mode signal which is switched depending on the resolution, monitors and checks whether or not a number of lines indicated by said horizontal sync signal matches up with said decoded value representing the number of lines.

3. The plasma display device according to claim 1, wherein said mode monitoring circuit further generates a decoded value representing a number of dots by decoding the operation mode signal which is switched depending on the resolution, monitors and checks whether or not a number of dots indicated by said analog digital clock signal matches up with said decoded value representing the number of dots.

4. The plasma display device according to claim 1, wherein said video signal processing circuit fixes an input average luminance level to be a pre-determined constant value, in synchronization with said video muting signal.

5. A plasma display device comprising: a plasma display panel;

a video signal processing circuit for supplying a video signal to said plasma display panel based on a vertical sync signal, a horizontal sync signal, and an analog digital clock signal; and a mode monitoring circuit for generating a decoded value representing a number of lines by decoding an operation mode signal which is switched depending on a resolution, and for monitoring and checking whether or not a number of lines indicated by said horizontal sync signal matches up with said decoded value, wherein said video signal processing circuit, while a result of the monitoring performed by said mode monitoring circuit shows non-matching between said indicated number of lines and said decoded value, outputs a video muting signal, instead of said video signal, to said plasma display panel.

6. The plasma display device according to claim 5, wherein said mode monitoring circuit further generates a decoded value representing a number of dots by decoding the operation mode signal which is switched depending on the resolution, monitors and checks whether or not a number of dots indicated by said analog digital clock signal matches up with said decoded value representing the number of dots.

7. The plasma display device according to claim 5, wherein said video signal processing circuit fixes an input average luminance level to be a pre-determined constant value, in synchronization with said video muting signal.

8. A plasma display device comprising:

a plasma display panel;

a video signal processing circuit for supplying a video signal to said plasma display panel based on a vertical sync signal, a horizontal sync signal, and an analog digital clock signal; and a mode monitoring circuit for generating a decoded value representing a number of dots by decoding an operation mode signal which is switched depending on a resolution, and for monitoring and checking whether or not a number of dots indicated by said analog digital clock signal matches up with said decoded value, wherein said video signal processing circuit, while a result of the monitoring performed by said mode monitoring circuit shows non-matching between said indicated number of dots and said decoded value, outputs a video muting signal, instead of said video signal, to said plasma display panel.

9. The plasma display device according to claim 8, wherein said video signal processing circuit fixes an input average luminance level to be a pre-determined constant value, in synchronization with said video muting signal.

* * * * *